US005193423A

United States Patent [19]

Bakker

[11] Patent Number: 5,193,423

[45] Date of Patent: Mar. 16, 1993

[54] METHOD AND DEVICE FOR CONVEYING MATERIAL STRIP PORTIONS CUT FROM A MATERIAL STRIP

[75] Inventor: Rinze P. Bakker, Almelo, Netherlands

[73] Assignee: Universal Corrguated B.V., Almelo, Netherlands

[21] Appl. No.: 609,832

[22] Filed: Nov. 5, 1990

[30] Foreign Application Priority Data

Nov. 7, 1989 [NL] Netherlands ..... 8902753

[51] Int. Cl.[5] ..... B26D 7/32; B65H 35/08

[52] U.S. Cl. ..... 83/24; 83/88; 83/110; 83/152; 83/155; 271/197; 271/202; 271/270

[58] Field of Search ..... 83/24, 88, 100, 152, 83/402, 436, 94, 110, 155, 156; 271/197, 202, 270

[56] References Cited

U.S. PATENT DOCUMENTS

| | | | |
|---|---|---|---|
| 1,545,912 | 7/1925 | Maxson | 271/202 |
| 2,852,256 | 9/1958 | Faulls, Jr. et al. | 271/197 |
| 3,595,564 | 7/1971 | De Young | 83/88 X |
| 3,682,543 | 8/1972 | Iwamoto | 83/203 X |
| 3,827,545 | 8/1974 | Buhayar | 271/203 X |
| 4,627,608 | 12/1986 | Harms | 271/197 |
| 4,632,381 | 12/1986 | Cuir et al. | 271/270 |
| 4,805,890 | 2/1989 | Martin | 271/203 |
| 4,886,263 | 12/1989 | Naito | 271/202 X |
| 5,014,582 | 5/1991 | Teik | 83/24 |

FOREIGN PATENT DOCUMENTS

| | | |
|---|---|---|
| 333986 | 1/1989 | European Pat. Off. . |
| 3838078 | 11/1988 | Fed. Rep. of Germany . |
| 2527570 | 12/1983 | France . |
| 2060575 | 5/1981 | United Kingdom . |
| 2076785 | 12/1981 | United Kingdom . |

*Primary Examiner*—Eugenia Jones
*Attorney, Agent, or Firm*—Christensen, O'Connor, Johnson & Kindness

[57] ABSTRACT

A conveying device for transporting strip portions to be cut by a cutting device from a material strip in transverse direction of the material strip, which strip portions are then laid overlapping in the manner of roof-tiles onto a stacker, comprising:

i) a first conveyor disposed adjacent the cutting device which transports the material strip for cutting and the cut strip portions at a first conveying speed $V_1$ which is substantially equal to the supply speed $V_0$ of the material strip; and ii) a second conveyor preceding the stacker which transports the cut strip portions at a second conveying speed $V_2$ which is greater than the first conveying speed $V_1$ and to a method for conveying strip portions cut from a material strip in transverse direction of the material strip, which strip portions are laid overlapping in the manner of roof-tiles on a stacker, comprising the steps of:

i) conveying with a first conveyor the material strip for cutting and the cut strip portion at a first conveying speed $V_1$ which is substantially equal to the supply conveying speed $V_0$ of the material strip; and ii) conveying with a second conveyor the cut strip portion at a second conveying speed $V_2$ which is greater than the first conveying speed $V_1$.

24 Claims, 4 Drawing Sheets

METHOD AND DEVICE FOR CONVEYING MATERIAL STRIP PORTIONS CUT FROM A MATERIAL STRIP

BACKGROUND OF THE INVENTION

The present invention relates to a conveying device and to a conveying method for transporting strip portions for cutting with a cutting device from a material strip in transverse direction of the material strip, which strip portions are then laid rooftile wise onto a stacker.

In the manufacture of for instance corrugated cardboard this strip-form material is fed at speeds up to 350 metres per minute to a cutting device in order to divide the material strip transversely into material portions of a desired length. The cutting device comprises two co-acting rollers provided with a knife blade and rotating in opposing directions, between which the material strip for cutting is guided. The knife blades cut the material strip with a scissor action, that is, from one side toward the other. In order during this cutting process to obtain a cutting line at right angles to the transporting direction the knife blades form an angle with the material strip. The cut strip portion is then transported at a higher speed to realize a mutual spacing, whereby it becomes possible to allow the trailing cut edge of the strip portion to fall to a level below the conveying surface during the subsequent stacking overlapping in the manner of roof-tiles. In this way the following strip portion can rise with its leading cut edge against the sloping surface of the stacked strip portion and, optionally using additional brush-like braking means, be slowed down to a conveying speed lower than the supply speed. A spacing of 10–30 cm, depending on the length of the product, is sufficient at a suitable speed to lay the successive strip portions overlapping in the manner of roof-tiles.

A drawback with this known conveying device and conveying method is that during cutting of the strip portion a tensile force is exerted thereon such that after being cut off the strip portion can immediately be accelerated to the desired higher conveying speed. The exertion of this tensile force on the strip portion for cutting off results, however, on the one hand to a greater tolerance for the cut-off length of the strip portion and on the other hand, owing to the relatively slow cutting process transversely of the strip portion, in the cut off portion being pulled crooked, which portion is then laid crooked on the subsequent transporting mechanism. This then leads during stacking in the stacker to damaging of the front protruding corner of the leading cut edge against the stop plate of the stacker, and to crooked stacking.

It is known that attempts have been made to correct the crooked roof-tile-like stacking of the strip portions by using rotating, cone-shaped rollers, between which the crooked strip portions are aligned. If, however, the material strip which is cut by the cutting device consists of a number of material strip bands of equal width, these bands will mutually overlap (so-called interlocking) under the influence of the conical rollers, whereby in the interlocked portion a greater stacking height is created in the stacking station, which can cause the strip portions to prematurely slide off one another to the side.

SUMMARY OF THE INVENTION

The invention has for its object to avoid crooked roof-tile-like stacking of the cut strip portions and is based on the insight that crooked stacking is caused by the fact that the tensile force necessary for the higher conveying speed is already exerted on the strip portion prior to cutting thereof. According to the invention this tensile force is only exerted on the strip portion once it is cut off, or on the strip portion for cutting off, but in the latter case this tensile force is neutralised and has no effect on the cutting process.

The invention thus provides a conveying device for transporting strip portions to be cut with a cutting device from a material strip in transverse direction of the material strip, which strip portions are then laid in a staggered, overlapping stack in the manner of roof-tiles onto a stacker, comprising:

i) a first conveyor to be connected onto the cutting device which transports the material strip for cutting and the cut strip portions at a first conveying speed $V_1$ which is substantially equal to the supply speed $V_0$ of the material strip; and ii) a second conveyor preceding the stacker which transports the cut strip portions at a second conveying speed $V_2$ which is greater than the first conveying speed $V_1$.

If the strip portion for cutting can fall under the influence of the second conveyor before being completely cut off, the first conveyor should be provided with a first conveying section connecting to the cutting device in which a grip is exerted on the strip portion such that the tensile force of the second conveyor is completely neutralised. In a subsequent second conveying section the grip is reduced, but the conveying speed is maintained so that from that moment, under the influence of the second conveyor, the meanwhile cut off strip portion can be removed from the second conveying section while making slipping contact.

The form of the first and second conveyor is in principle not of essential importance. However, a so-called vacuum conveyor is preferably used for the first conveyor, since the material strip for transporting and the cut strip portions are therein easily accessible from the top or the bottom. If a first and second conveying section are used, this vacuum conveyor comprises a first vacuum chamber and a second vacuum chamber located downstream thereof, wherein the pressure $P_1$ in the first vacuum chamber is lower than the pressure $P_2$ in the second vacuum chamber.

In order to avoid the material strip crumpling at the transition from the cutting device to the first conveyor, it is further recommended that a rise surface of the first conveyor connecting to the cutting device inclines upward from a position under a transporting surface of the cutting device. The paper strip is thus guided upward with support to the first conveyor.

According to another embodiment of the conveying device according to the invention, the tensile force necessary for the higher conveying speed is first exerted on the cut strip portion since the second conveyor comprises a transporting member which only comes into conveying contact with the strip portion with reciprocating means after this strip portion has been cut from the material strip. The second conveyor is thus only placed in a transporting position after the strip portion has been cut from the material strip. After the cut strip portion has passed over the second conveyor, the reciprocating means preferably remove the transporting member from the transporting surface of the second conveyor. In order to enable optimal technical control, the reciprocating means preferably comprise a detector which detects the passage of the rear edge of the strip portion.

According to a third embodiment to be discussed hereafter, the tensile force is only exerted on the cut strip portion in that, after the cutting process is ended, the second conveyor is activated such that it raises its conveying speed from $V_1$ to $V_2$ until the cut off strip portion has passed, whereafter its conveying speed returns to a conveying speed substantially equal to $V_1$.

In order to ensure that the material strip retains its shape and is substantially not butted, it is necessary for the first conveyor to have the same or the smallest possible overspeed. Therefore the first conveying speed is $V_1=V_0+0\text{–}5\%$, preferably $V_0+0\text{–}1.5\%$. The second conveying speed for realizing the temporarily accelerated transport is considerably greater than $V_1$, namely $V_2=V_0+10\text{–}30\%$, preferably $V_0+10\text{–}20\%$.

The invention further relates to the more general transport principle underlying the conveying device according to the invention. This conveying method comprises for transporting strip portions cut from a material strip in transverse direction of the material strip, which strips are laid overlapping in the manner of roof-tiles on a stacker, the steps of:

i) transporting with a first conveyor the material strip for cutting and the cut strip portion at a first conveying speed $V_1$ which is substantially equal to the supply conveying speed $V_0$ of the material strip; and ii) transporting with a second conveyor the cut strip portion at a second conveying speed $V_2$ which is greater than the first conveying speed $V_1$.

If in preference the first conveyor comprises a first conveying section which exerts a high grip on the strip portion and a second conveying section which exerts a lower grip on the strip portion, and wherein the second conveyor grips the strip portion with a grip such that the strip portion can only be removed from the second conveying section while making slipping contact with the second conveying section, a pressure $P_1$ prevails in the first vacuum conveying section and a pressure $P_2$ in the second vacuum conveying section, where $P_1<P_2$.

According to a second embodiment a transporting member of the second conveyor is preferably then first placed into a transporting position after the strip portion has been cut from the material strip, and removed from this transporting position after passage of the strip portion.

According to a third embodiment of the conveying method according to the invention, the conveying speed of the second conveyor is preferably raised from a conveying speed substantially equal to $V_1$ to the second conveying speed $V_2$ when the strip portion has been cut off and, after this strip portion has passed through the second conveyor, the conveying speed is reduced to a conveying speed substantially equal to $V_1$.

The conveying device and the conveying method according to the invention will be elucidated in further detail hereinafter on the basis of a number of non-limiting embodiments, with reference to the annexed drawings.

DETAILED DESCRIPTION OF THE PREFERRED EMBODIMENTS

Figure 1:
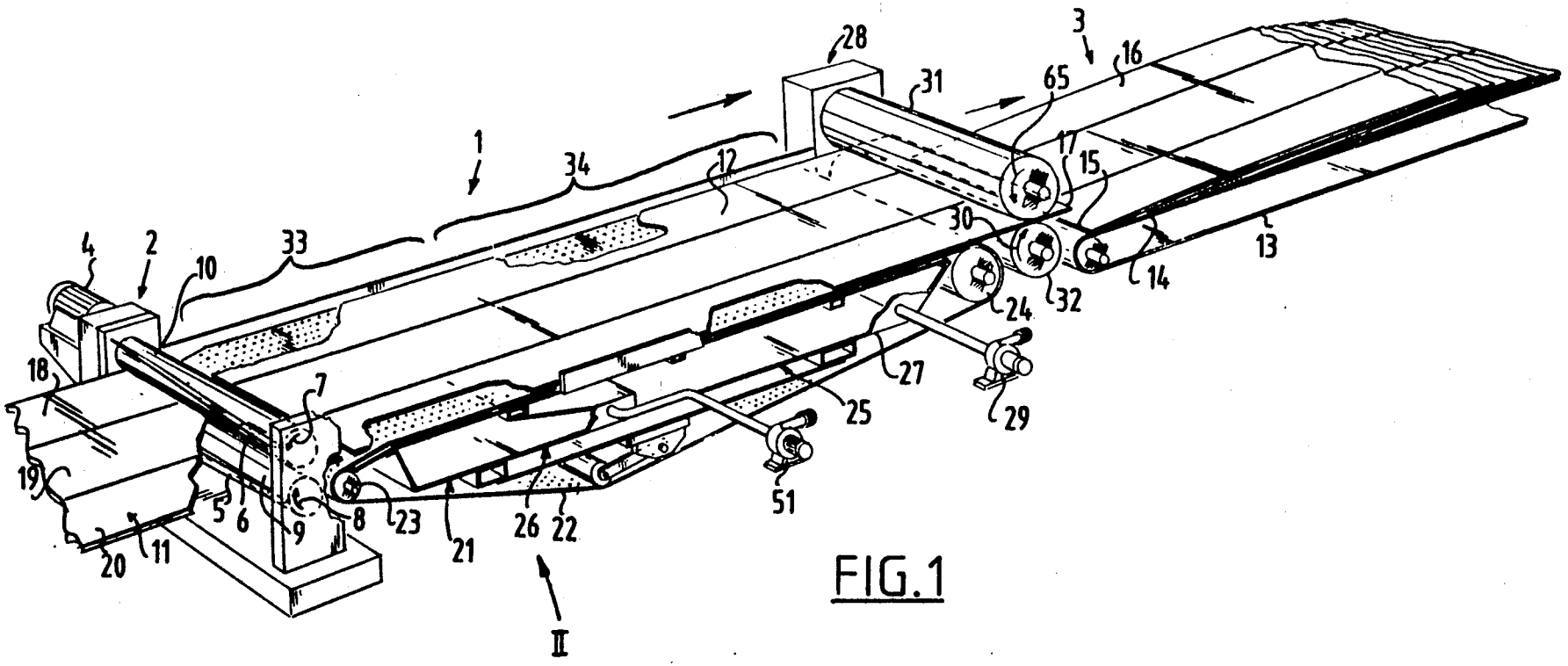
FIG. 1 shows a perspective, partially broken away view of a conveying device according to the invention.

FIG. 1 shows the conveying device 1 according to the invention, which in this case is arranged in a device for manufacturing corrugated cardboard. The conveying device 1 connects onto a cutting device 2, and is followed by a stacker 3.

The cutting device 2 comprises mutually co-acting rollers 9, 10, driven by a motor 4, provided with a curved knife blade 5, 6 and rotating in opposing directions according to the arrows 7, 8. Using this per se known cutting device a material strip 11 is cut into strip portions 12 which are laid overlapping in the manner of roof-tiles on a conveyor belt 13 of the stacker 3. It is noted that the transporting surface 14 of the conveyor belt 13, which is formed by the upper part thereof, lies at a level lower than the level from where the strip portion 12 is supplied. In other words: the trailing cut edge 15 of the laid off strip portion 16 lies at a lower level than the leading cut edge 17 of the strip portion 12.

As shown in FIG. 1, the material strip 11 consists of three adjoining material strip widths 18–20.

The conveying device 1 according to the invention consists in this embodiment of a vacuum conveyor 21, which comprises a perforated conveyor belt 22 which is guided by means of reversing rollers 23, 24 around a vacuum box 25. This vacuum box comprises a first vacuum chamber 26 and a second vacuum chamber 27. Using the respective vacuum pumps 51 and 29 an underpressure is applied in both vacuum chambers 26 and 27, wherein the pressure $P_1$ in the first vacuum chamber 26 is lower than in the second vacuum chamber 27.

The perforated conveyor belt 22 of the vacuum conveyor 21 is driven at a speed such that the conveying speed $V_1$ is substantially equal to or greater than the supply speed $V_0$ of the material strip 11. Substantially equal means in this case that $V_1$ is raised with a so-called overspeed, whereby the material strip 11 is held taut. This overspeed amounts to about 0–5%, and preferably 0–1.5% of the supply speed $V_0$.

Connecting onto the first vacuum conveyor 21 is a second conveyor 28 which comprises a pair of transporting rollers 31 and 32 turning in opposing directions according to the arrows 30 and 65 respectively which can transport the strip portion 12 at a conveying speed $V_2$ which is greater than the first conveying speed $V_1$ such that a sufficient spacing is arranged between the strip portions 12 and 11. The conveying speed $V_2$ is for example $V_0+10\text{–}30\%$, and more preferably $V_0+10\text{–}20\%$.

The material strip 11 and the cut strip portion 12 are sucked fixedly onto the perforated conveyor belt 22 under the influence of the vacuum. The grip therein created is greater in a first conveying section 33 above the first vacuum chamber 26 than in a second conveying section 34 located above the second vacuum chamber 27. Further, the grip exerted in the first conveying section 33 is greater than the grip exerted with the transport rollers 31, 32. Thus achieved is that the tensile force exerted by these transport rollers 31, 32 is neutralised in the first conveying section 33 and therefore has no influence on the cutting process in the cutting device 2.

The ideal length of the first conveyor 1 is a length which is slightly longer than the longest cut-off length of the material strip 12. However, with relatively long strip portions (varying from 0.5 m to 7 m), the conveying device 1 according to the invention would be too long and could not be fitted into existing devices for manufacturing and cutting material strips. In practice it has been found practical for the conveying section 33 to have a length of about 0.2–1 m, and the subsequent second conveying section to have a length of 0.5–2 m.

As long as the strip portion 12 is in the sphere of influence of the first conveying section 33, the transport rollers 31, 32 make slipping contact with this strip portion 12. After passing over or passing in large part over the conveying section 33 (decreasing grip) this slipping contact of the transport rollers 31, 32 will lessen and the strip portion will be accelerated to the second conveying speed $V_2$. If the strip portions 12 are relatively short, the cut strip portion can then already be present in the second conveying section 34 before entering the sphere of influence of the second conveyor 28 which, after contact, accelerates the strip portion 12 to the second conveying speed $V_2$.

Figure 2:
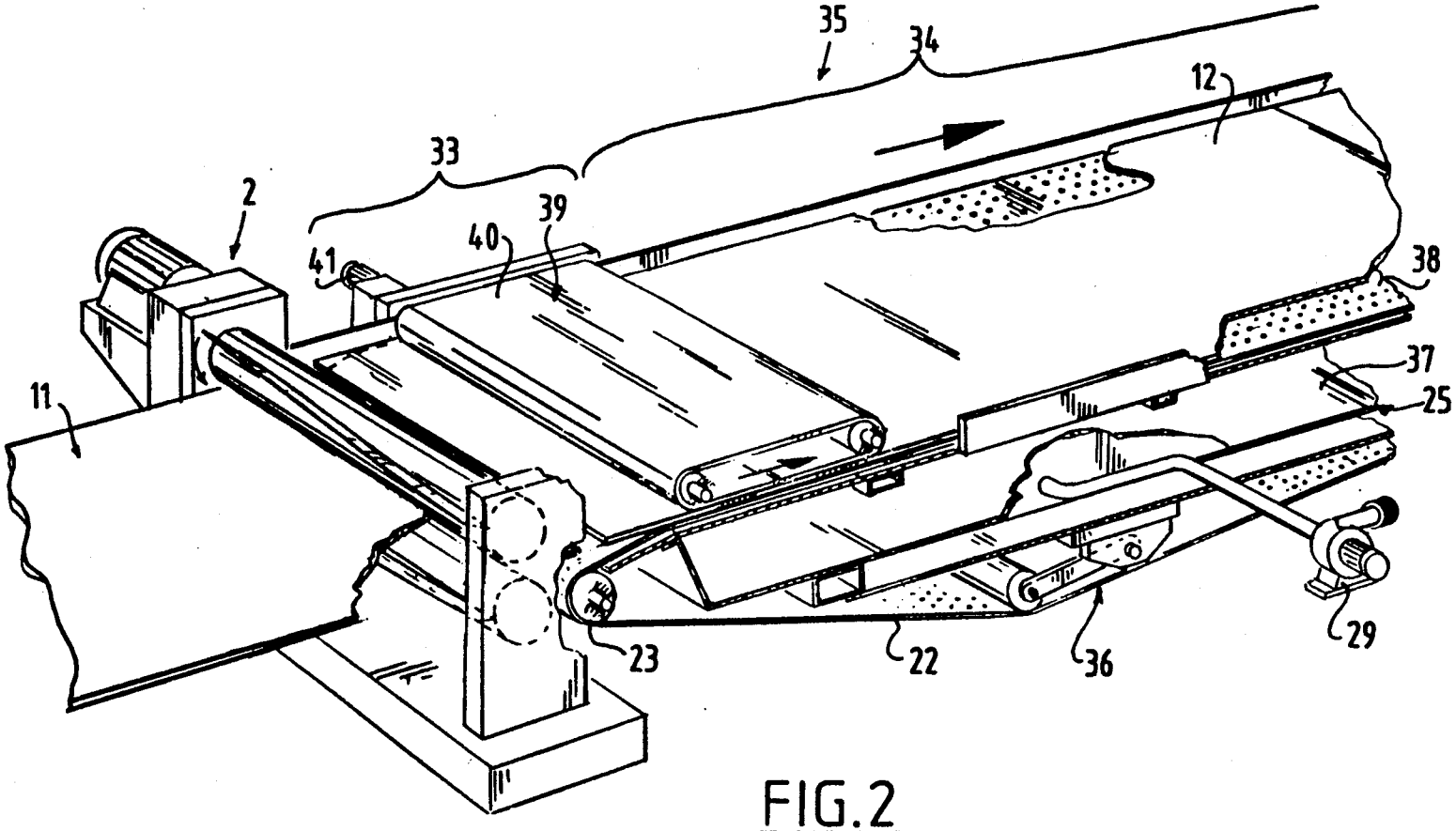
FIG. 2 shows on a larger scale a variant of detail II from FIG. 1.

FIG. 2 shows a variant of the conveying device 1 according to the invention. The same or equivalent device elements are designated with the same reference numerals.

This conveying device 35 comprises a vacuum conveyor 36 with a perforated conveyor belt 22 which is guided around the vacuum box 25 which is provided with one vacuum chamber 37, the underpressure of which is maintained with the vacuum pump 29. The greater grip which is exerted on the strip portion 12 or the material strip for cutting 11 is effected by a conveyor 39 located above the upper part 38 of the conveyor belt 22 which, with the conveyor belt 40 driven by the motor 41, exerts a grip such that the strip portion 12 can then only be transported through the conveyor 28 at the greater conveying speed $V_2$ after the strip portion 12 has wholly or substantially left the first conveying section 33 and has arrived in the second conveying section 34.

Figure 3:
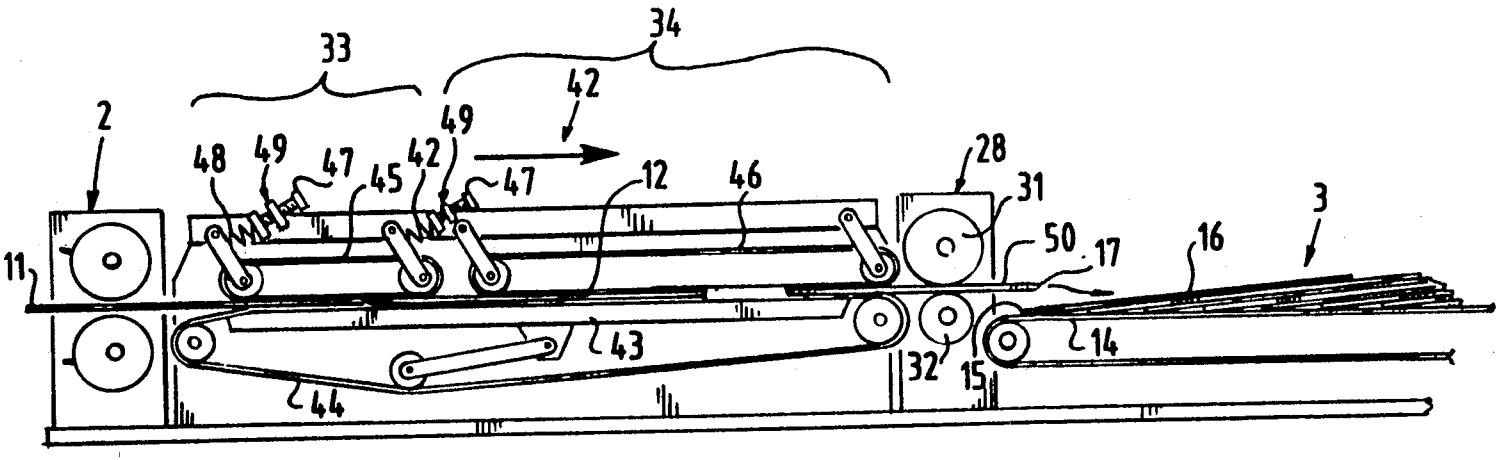
FIG. 3 shows a longitudinal section of a conveying device according to the invention in yet another embodiment.

In the conveying device 42 according to the invention which is shown in FIG. 3, use is only made of belt conveyors, namely a conveyor belt 44 trained round a support plate 43 and subsequent thereto conveyor belts 45 and 46 forming a sandwich conveyor. Using adjusting means 49 formed by an adjusting bolt 47 and a spring 48, the grip on the material strip 11 and the cut strip portion 12 in the first conveying section 33 is adjusted such that the tensile force exerted with the second conveyor 28 does not affect the cutting process performed with the cutting device 2.

In this case the strip portions 12 have a relatively short length, and the strip portion 12 first enters the second conveying section 34 before it is gripped by the second conveyor 28, which transports the strip portion 50 accelerated to the increased conveying speed $V_2$ in the direction of the stacker 3.

Figure 4:
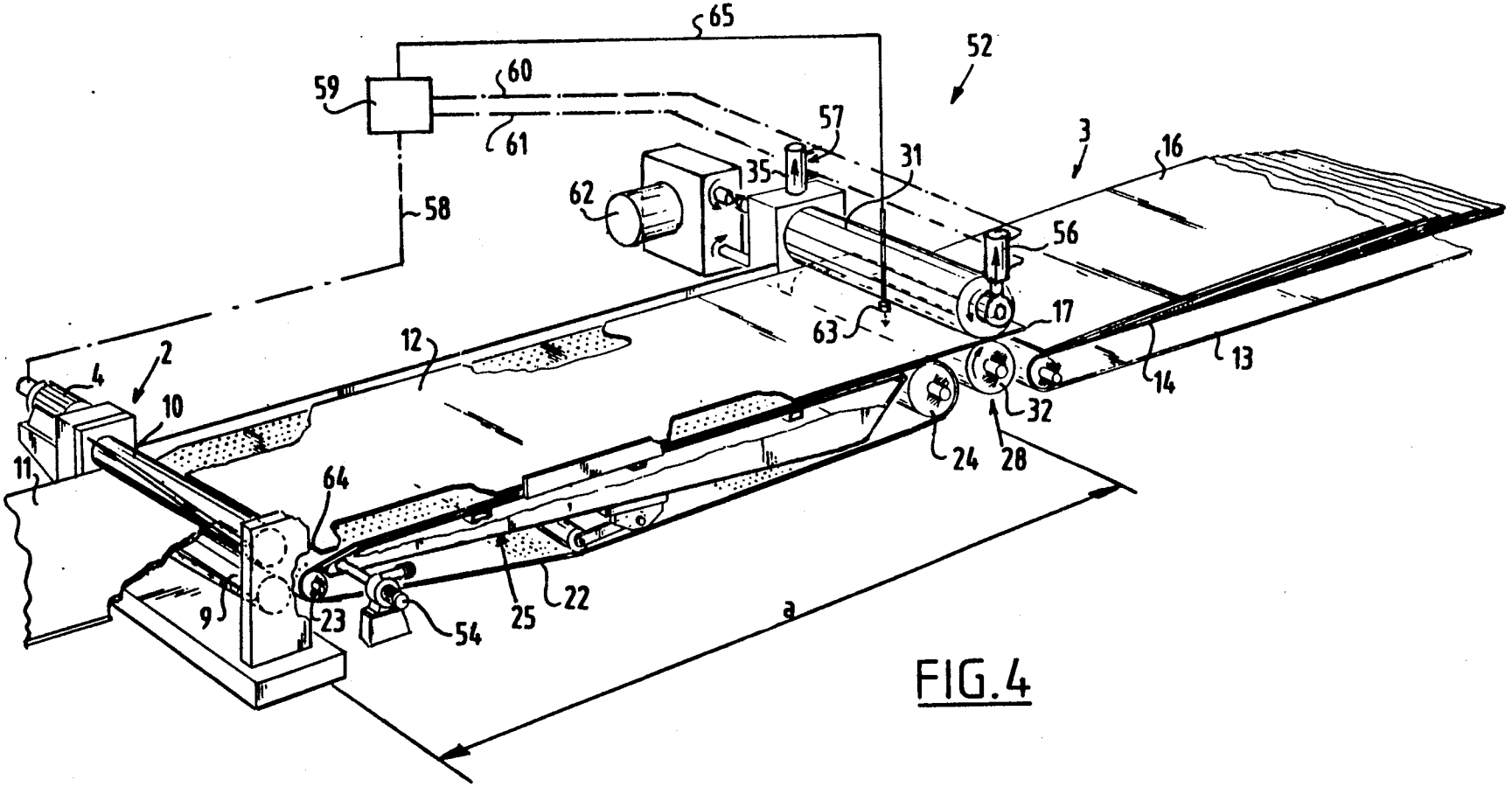
FIG. 4 is a view corresponding with FIG. 1 of yet another embodiment of the conveying device according to the invention.

FIG. 4 shows a conveying device 52 according to the invention, which is particularly used if the length of the cut strip portion 12 is greater than the distance a between the cutting device 2 and the second conveyor 28. In this case the first conveyor 53 comprises a vacuum conveyor with a simple vacuum box, in which a vacuum decreasing in the conveying direction is maintained with a vacuum pump 54. This vacuum has the function of holding fixedly the strip portion 12 for cutting and not the function of neutralising a tensile force generated by the second conveyor 28—the second conveyor 28 is first activated after the cutting.

The strip portion 12 for cutting off is therefore well fixed on the perforated conveyor belt 22 during the cutting process performed by the cutting device 2. In the meantime however the leading edge 17 of the now cut off strip portion 12 has passed the second conveyor 28, wherein the strip portion 12 rests only on the transport roller 32, which rotates a rotation speed corresponding to the conveying speed $V_1$. However, using reciprocating means 57 comprising cylinders 55 and 56, the upper transport roller 31 is raised from the conveying position wherein contact is made with the surface of the strip portion 12. After the cutting process a signal is passed via an information line 58 from the cutting device 2 to the processing unit 59, which in turn activates both the cylinders 55 and 56 via the information lines 60 and 61 such that the upper transport roller 31 is placed in the conveying position. Using a motor 62 both transport rollers 31 and 32 are moreover brought to the second conveying speed $V_2$, whereby after making contact with the strip portion 12, this strip portion 12 is transported at the higher speed to the stacker 3. After passage of the rear cut edge 64 has been detected using a detector 63, this information is passed via the information line 65 to the processing unit 59, which in turn removes the transport roller 31 out of the conveying position by means of cylinders 55 and 56, this being done before the leading edge of the following strip portion for cutting off reaches the second conveyor 28.

According to another variant it is possible to maintain the conveying speed of the upper transport roller 31 constantly at conveying speed $V_2$. The cut strip portion 12 is then only transported after the upper transport roller 31 is brought into the conveying position (exerting grip on the strip portion 12). Further, the conveying speed of the transport roller 32 is returned to the conveying speed $V_1$. It is thus once again possible to cut the material strip 11 without tensile force and only then to transport the cut strip portion 12 at a higher speed once it has been cut off.

According to yet another variant it is possible to use the processing unit 59 to directly control the motor 62 and not carry the transport roller 31 out of its conveying position. In this case the transport rollers 31 and 32 turn at a first conveying speed which is equal to $V_1$, but their conveying speed is temporarily raised to $V_2$ after the strip portion 12 is cut by the cutting device 2. The conveying speed is then lowered once again to $V_1$ after passage of the rear edge 64 is observed by the detector 63.

The embodiments of the invention in which an exclusive property or privilege is claimed are defined as follows:

1. A conveying device for transporting strip portions cut by a cutting device from a material strip in the transverse direction of the material strip, which strip portions are then laid in a staggered, overlapping stack onto a stacker, comprising:

(i) a first conveyor disposed downstream from the cutting device which transports the material strip for cutting and the cut strip portions at a first conveying speed $V_1$, wherein $V_1$ is equal to a supply speed $V_0$ of the material strip to the cutting device plus from 0% to 5% $V_0$; and (ii) a second conveyor disposed downstream from the first conveyor and preceding the stacker which transports the cut strip portions at a second conveying speed $V_2$ which is greater than the first conveying speed $V_1$.

2. A conveying device as claimed in claim 1, wherein the first conveyor grips the strip portion and comprises a first conveying section and a second conveying section, and the grip exerted on the strip portion for conveying in the second conveying section is lower than that in the first conveying section; and wherein the second conveyor grips the strip portion with a grip such that the strip portion can only be removed from the second conveying section with slipping contact between the strip portion and the second conveying section.

3. A conveying device as claimed in claim 1, wherein first conveyor comprises a vacuum conveyor.

4. A conveying device as claimed in claim 3, wherein the vacuum conveyor comprises a first vacuum chamber and a second vacuum chamber located downstream thereof, wherein the pressure $P_1$ in the first vacuum chamber is lower than the pressure $P_2$ in the second vacuum chamber.

5. A conveying device as claimed in claim 1, wherein a rise surface of the first conveyor disposed adjacent the cutting device inclines upward from a position under a transport surface of the cutting device.

6. A conveying device as claimed in claim 1, wherein the second conveyor comprises a transporting member, a conveying surface and means for reciprocating the transporting member relative to the conveying surface so that the transporting member only comes into conveying contact with the strip portion after the strip portion has been cut from the material strip.

7. A conveying device as claimed in claim 6, wherein the reciprocating means remove the transporting member from the conveying surface of the second conveyor after the cut strip portion has passed over the second conveyor.

8. A conveying device as claimed in claim 7, wherein the reciprocating means comprise a detector which detects the passage of the rear edge of the strip portion.

9. A conveying device as claimed in claim 6, wherein the transporting member of the second conveyor comprises an upper roller and the conveying surface of the second conveyor comprises a lower roller, wherein the upper roller is reciprocally moveable with the reciprocating means relative to the lower roller.

10. A conveying device as claimed in claim 1, wherein the second conveying speed $V_2=V_0+10\%$ to 30% $V_0$.

11. A conveying device as claimed in claim 1, wherein the first conveying speed $V_1=V_0+0\%$ to 1.5% $V_0$.

12. A conveying device as claimed in claim 1, wherein the second conveying speed $V_2=V_0+10\%$ to 20% $V_0$.

13. A method for conveying strip portions cut by a cutting device from a material strip in the transverse direction of the material strip, which strip portions are subsequently laid in a staggered, overlapping stack on a stacker, comprising the steps of:

(i) conveying with a first conveyor disposed downstream from the cutting device the material strip for cutting and the cut strip portion at a first conveying speed $V_1$, wherein $V_1$ is equal to a supply conveying speed $V_0$ of the material strip to the cutting device plus from 0% to 5% $V_0$; and (ii) conveying with a second conveyor the cut strip portion at a second conveying speed $V_2$ which is greater than the first conveying speed $V_1$ wherein the second conveyor is disposed downstream from the first conveyor and upstream from the stacker.

14. A method as claimed in claim 13, wherein the first conveyor comprises a first conveying section which exerts a high grip on the strip portion and a second conveying section that exerts a lower grip on the strip portion, and wherein the second conveyor grips the strip portion with a grip such that the strip portion can only be removed from the second conveying section while making slipping contact with the second conveying section.

15. A method as claimed in claim 13, wherein the conveying speed of the second conveyor is increased from a conveying speed which is substantially equal to $V_1$ to the conveying speed $V_2$ when the strip portion is cut off and, after the strip portion has passed over the second conveyor, the conveying speed is reduced to a conveying speed substantially equal to $V_1$.

16. A method as claimed in claim 13, wherein a transporting member of the second conveyor is first brought into a conveying position after the strip portion has been cut from the material strip and is removed from the conveying position after passage of the strip portion.

17. A method as claimed in claim 16, where the conveying speed of the transporting member is substantially equal to $V_2$.

18. A method as claimed in claim 13, wherein the second conveying speed $V_2=V_0+10\%$ to 30% $V_0$.

19. A method as claimed in claim 13, wherein the first conveyor comprises a vacuum conveyor.

20. A method as claimed in claim 19, wherein the first conveyor comprises a vacuum conveyor including a first vacuum conveying section in which a pressure $P_1$ prevails and a second vacuum conveying section in which a pressure $P_2$ prevails, wherein $P_1$ is less than $P_2$.

21. A method as claimed in claim 13, wherein the first conveying speed $V_1=V_0+0\%$ to 1.5% $V_0$.

22. A method as claimed in claim 13, wherein the second conveying speed $V_2=V_0+10\%$ to 20% $V_0$.

23. A conveying device for transporting strip portions cut from a material strip in the transverse direction of the material strip, which strip portions are then laid in a staggered, overlapping stack onto a stacker, comprising:

(i) a cutting device;

(ii) a first conveyor disposed downstream from the cutting device which transports the material strip during cutting and the cut strip portions at a first conveying speed $V_1$, wherein $V_1$ is equal to a supply speed $V_0$ of the material strip to the cutting device plus from 0% to 5% $V_0$; and (iii) second conveyor means disposed downstream from the first conveyor and preceding the stacker for transporting the cut strip portions, after having been cut free of the material strip, at a second conveying speed $V_2$ which is greater than the first conveying speed $V_1$.

24. A method for cutting and conveying strip portions cut by a cutting device from a material strip in the transverse direction of the material strip, which strip portions are subsequently laid in a staggered, overlapping stack on a stacker, comprising:

(i) cutting a strip portion from the material strip with the cutting device;

(ii) conveying with a first conveyor disposed downstream from the cutting device the material strip for cutting and the cut strip portion at a first conveying speed $V_1$, wherein $V_1$ is equal to a supply conveying speed $V_0$ of the material strip to the cutting device plus from 0% to 5% $V_0$; and (iii) conveying with a second conveyor the cut strip portion, after having been cut free of the material strip, at a second conveying speed $V_2$ which is greater than the first conveying speed $V_1$ wherein the second conveyor is disposed downstream from the first conveyor and upstream from the stacker.

* * * * *

UNITED STATES PATENT AND TRADEMARK OFFICE

CERTIFICATE OF CORRECTION

PATENT NO. : 5,193,423

DATED : March 16, 1993

INVENTOR(S) : R. P. Bakker

It is certified that error appears in the above-identified patent and that said Letters Patent is hereby corrected as shown below:

| COLUMN | LINE | |
|---|---|---|
| [73] | Assignee | "Universal Corrguated B.V., Almelo, Netherlands" should read --Universal Corrugated B.V., Almelo, Netherlands-- |
| 6 | 12 | after "rotates" insert --at-- |
| 7 (Claim 3 | 17 Line 1) | after "wherein" insert --the-- |
| 8 (Claim 17 | 30 Line 1) | "where" should read --wherein-- |

Signed and Sealed this

Twenty-second Day of February, 1994

*Attest:*

Bruce Lehman

BRUCE LEHMAN

*Attesting Officer*

*Commissioner of Patents and Trademarks*